US006808387B1

(12) United States Patent
Li

(10) Patent No.: US 6,808,387 B1
(45) Date of Patent: Oct. 26, 2004

(54) DUAL-ACTION PIEZOELECTRIC LIGHTER

(76) Inventor: Wen Qian Li, 2211 S. Hacienda Blvd., Suite 107, Hacienda Heights, CA (US) 91745

( * ) Notice: Subject to any disclaimer, the term of this patent is extended or adjusted under 35 U.S.C. 154(b) by 0 days.

(21) Appl. No.: 10/648,683

(22) Filed: Aug. 27, 2003

(51) Int. Cl.[7] ..... F23D 11/36
(52) U.S. Cl. ..... 431/153; 431/255
(58) Field of Search ..... 431/153, 255, 431/130, 132

(56) References Cited

U.S. PATENT DOCUMENTS 6,478,575 B2 * 11/2002 Sher ..... 431/153
6,682,341 B2 * 1/2004 Pan et al. ..... 431/153
6,688,879 B2 * 2/2004 Tsai ..... 431/153
2003/0157449 A1 * 8/2003 Suzuki et al. ..... 431/153

* cited by examiner

*Primary Examiner*—Alfred Basichas
(74) *Attorney, Agent, or Firm*—Raymond Y. Chan; David & Raymond Patent Group

(57) ABSTRACT

A dual-action safety arrangement for a piezoelectric lighter includes an axle holder provided at an inner side of a casing and an ignition cap, which is slidably mounted on a ceiling of the casing in a radially movable manner about an operation axle held at the axle holder, including a depressing arm extended to rest on top of a piezoelectric unit. To ignite the piezoelectric lighter, the ignition cap must be radially and rearwardly slid to actuate a gas emitting nozzle for releasing the gas from a liquefied gas storage and simultaneously depressed to depress a movable operating part of the piezoelectric unit to generate sparks to ignite the gas emitted from the gas emitting nozzle so as to ignite the piezoelectric lighter.

20 Claims, 4 Drawing Sheets

DUAL-ACTION PIEZOELECTRIC LIGHTER

BACKGROUND OF THE PRESENT INVENTION

1. Field of Invention

The present invention relates to a piezoelectric lighter, and more particularly to a dual-action piezoelectric lighter, wherein an adult's user must apply a sideward sliding force and a downward pressing force on an ignition cap simultaneously to ignite the piezoelectric lighter, so as to prevent the piezoelectric lighter from being ignited accidentally or by children.

2. Description of Related Arts

Piezoelectric lighters have been known and sold throughout the United States. The conventional push-down type piezoelectric lighter generally comprises a cap which covers on top of the lighter. In order to ignite the lighter, a user must open the cap and downwardly depress an ignition button. The cap can prevent the lighter from being ignited accidentally. However, it cannot stop children from the usage of the piezoelectric lighter.

To solve the drawbacks set forth above, the push-down type piezoelectric lighter button may employ a safety switch to prevent the depression of the ignition button. However, for some other slide-down type piezoelectric lighter, the ignition button must be pushed to slide sidewardly for ignition, the conventional safety switch designed for locking up the downward ignition button must be altered to fit the structure of such slide-down type piezoelectric lighter.

An improved slide-down type piezoelectric lighter which comprises a locking member disposed in the ignition cap for blocking up the ignition cap for being slid sidewardly with respect to the casing of the piezoelectric lighter so as to lock up the ignition cap from ignition. In other words, the locking member is downwardly extended into the casing of the lighter in order to block up the rotation of the ignition. However, the structure of the ignition cap must be altered in order to incorporate with the locking member in a slidably movable manner. In addition, the size of the casing must be enlarged to create enough space for the locking member extending therein. Therefore, such structural alternation of the piezoelectric lighter will highly increase the manufacturing cost thereof.

Thus, convenient and safety in the context of piezoelectric lighters always have contradiction. The degree to which convenience is 'traded' with safety is of overriding interest to both manufacturers as well as end users of the piezoelectric lighters. However, optimal safety piezoelectric light has not yet been invented.

Yet in conjunction with the forgoing elaboration of the usual operation of conventional safety lighters, one further disadvantage which is not obvious to people is that such kind of conventional safety lighter require the user to intentionally unlock the safety device before igniting the lighter. However, this possesses considerable inconvenience to the users.

SUMMARY OF THE PRESENT INVENTION

A main object of the present invention is to provide a dual-action piezoelectric lighter, wherein an adult's user must apply a sideward sliding force and a downward pressing force on an ignition cap simultaneously to ignite the piezoelectric lighter, so as to prevent the piezoelectric lighter from being ignited accidentally or by children.

Another object of the present invention is to provide a dual-action piezoelectric lighter, wherein the piezoelectric lighter cannot be ignited when the ignition cap is rearwardly and sidewardly slid at a gas releasing position. In other words, the adult's user must depress the ignition cap at the gas releasing position in order to ignite the piezoelectric lighter. Therefore, children under five years old are unable to complete the ignition operation.

Another object of the present invention is to provide a dual-action piezoelectric lighter, wherein the ignition operation requires both a sliding movement and a depressing movement performing at the same time to form a single ignition action, so as to prevent any intentional ignition of the piezoelectric lighter.

Another object of the present invention is to provide a dual-action piezoelectric lighter, wherein the piezoelectric lighter does not need to alter the original structural design for the dual-action operation, so as to minimize the manufacturing cost of the piezoelectric lighter.

Another object of the present invention is to provide a dual-action piezoelectric lighter, wherein no expensive or complicated mechanism is required to employ in the present invention in order to achieve the above mentioned objects. Therefore, the present invention successfully provides an economic and efficient solution for providing safety configuration for the piezoelectric lighter.

Accordingly, in order to accomplish the above objects, the present invention provides a dual-action piezoelectric lighter, comprising:

a casing receiving a liquefied gas storage;

a gas emitting nozzle disposed in the casing and communicating with the liquefied gas storage for controlling a flow of gas;

a piezoelectric unit disposed in the casing for generating piezoelectricity; and a dual-action safety arrangement, which comprises:

an axle holder provided at an inner side of the casing; and an ignition cap, which is slidably mounted on a ceiling of the casing in a radially movable manner about an operation axle held at the axle holder, comprising a depressing arm extended to rest on top of the piezoelectric unit, wherein the ignition cap is capable of moving to a gas releasing position that the ignition cap is radially and rearwardly slid to actuate the gas emitting nozzle for releasing the gas from the liquefied gas storage while the ignition cap is capable of being simultaneously depressed to depress a movable operating part of the piezoelectric unit to generate sparks to ignite the gas emitted from the gas emitting nozzle so as to ignite the piezoelectric lighter.

These and other objectives, features, and advantages of the present invention will become apparent from the following detailed description, the accompanying drawings, and the appended claims.

DETAILED DESCRIPTION OF THE PREFERRED EMBODIMENT

Figure 1:
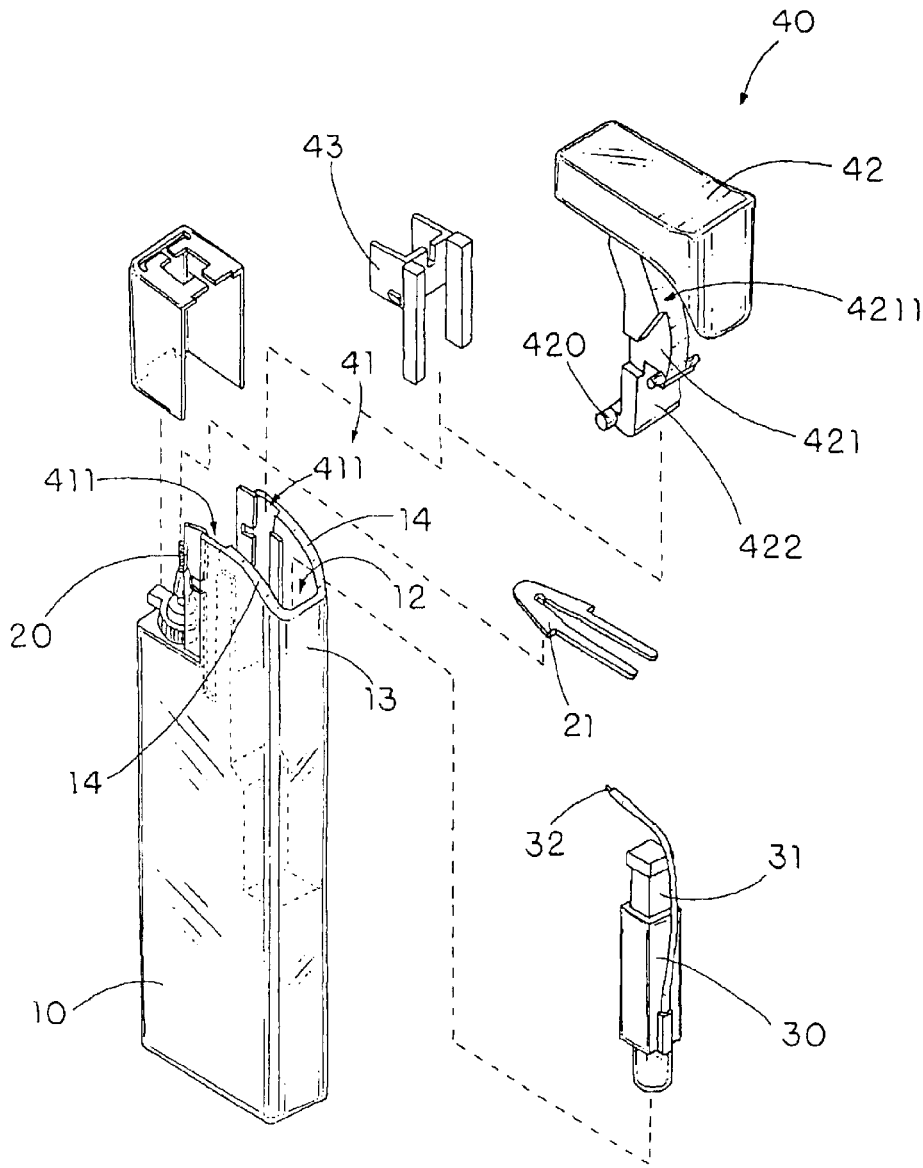
FIG. 1 is an exploded perspective view of a dual-action piezoelectric lighter according to a preferred embodiment of the present invention.
Figure 2:
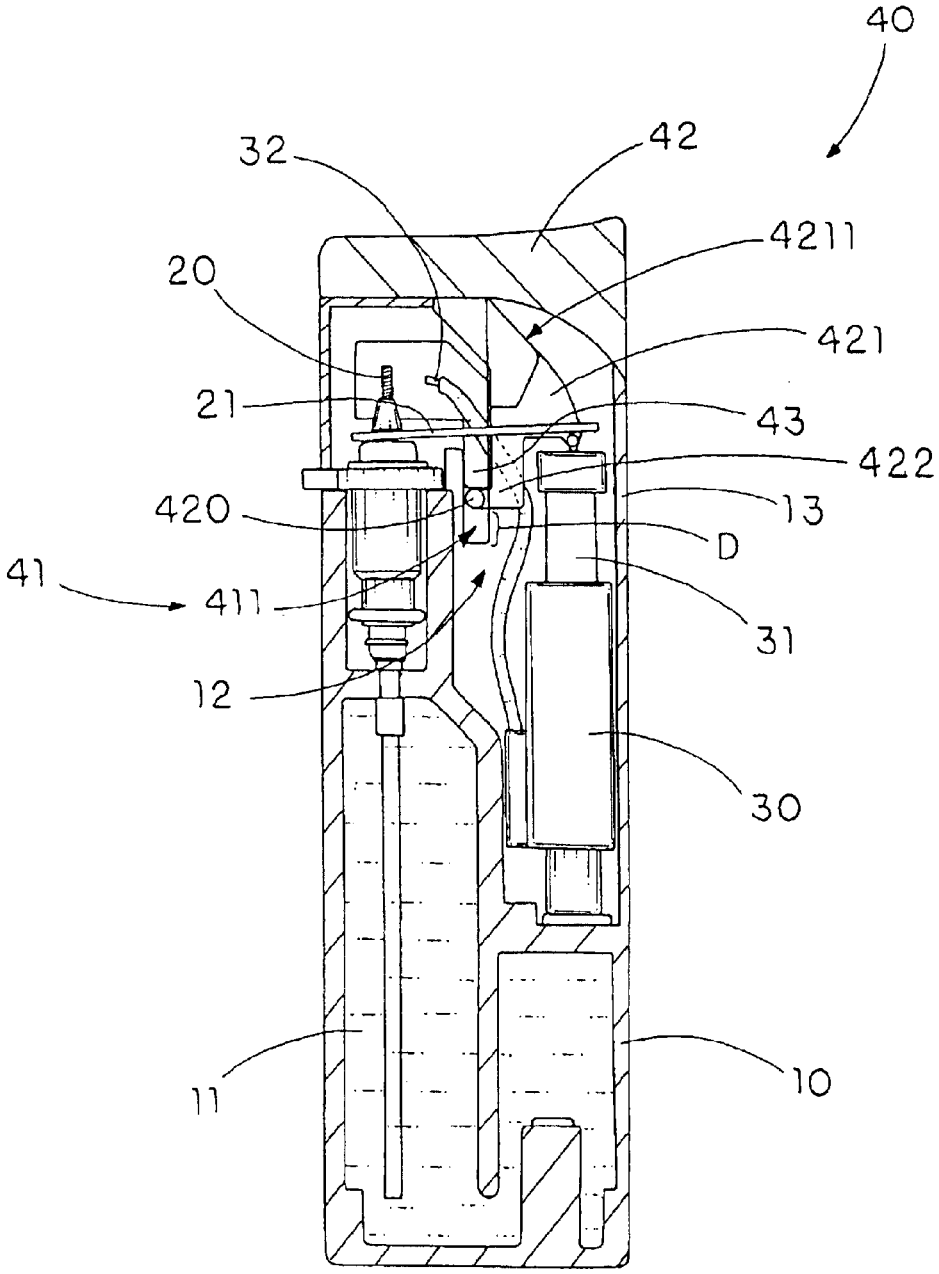
FIG. 2 is a sectional view of the dual-action piezoelectric lighter according to the above preferred embodiment of the present invention.

Referring to FIGS. 1 and 2 of the drawings, a dual-action piezoelectric lighter according to a preferred embodiment of the present invention is illustrated, wherein the dual-action piezoelectric lighter, such as a conventional piezoelectric lighter, comprises a casing 10 receiving a liquefied gas storage 11 and an ignition cavity 12 provided therein, a gas emitting nozzle 20 disposed in the casing 10 and communicating with the liquefied gas storage 11 for controlling a flow of gas, and a piezoelectric unit 30 disposed in the casing 10 for generating piezoelectricity.

The piezoelectric unit 30 comprises a movable operating part 31 extended upwardly and an ignition tip 32 extended to a position close to the gas emitting nozzle 20, wherein when the movable operating part 31 is depressed downwardly, the ignition tip 32 generates sparks to ignite the gas emitted from the gas emitting nozzle 20 at the same time.

The dual-action piezoelectric lighter further comprises a dual-action safety arrangement 40 which comprises an axle holder 41 provided at an inner side of the casing 10 and an ignition cap 42, which is slidably mounted on a ceiling of the casing 10 in a radially movable manner about an operation axle 420 held at the axle holder 41, comprising a depressing arm 421 extended to rest on top of the piezoelectric unit 30. The ignition cap 42 is capable of moving to a gas releasing position that the ignition cap 42 is radially and rearwardly slid to actuate the gas emitting nozzle 20 for releasing the gas from the liquefied gas storage 11 while the ignition cap 42 is capable of being simultaneously depressed to depress the movable operating part 31 of the piezoelectric unit 30 to generate sparks to ignite the gas emitted from the gas emitting nozzle 20 so as to ignite the piezoelectric lighter.

According to the preferred embodiment, the axle holder 41 has two elongated holding grooves 411 provided at two sidewalls 14 of the casing 10 at inner sides thereof respectively to rotatably hold the operation axle 420 of the ignition cap 42 in position. Each of the holding grooves 411, which is indented on the respective inner side of the casing 10, has a predetermined length extended from a top edge of the casing 10 in such a manner that the operation axle 420 is guided to slide along the holding grooves 411 to radially slide the ignition cap 42 to the gas releasing position.

The operation axle 420 is supported within the ignition cavity 12 of the casing 10 wherein two outer end portions of the operation axle 420 are slidably received in the holding grooves 411 of the axle holder 41 respectively so as to guide the radial movement of the ignition cap 42. Accordingly, the operation axle 420 is positioned above a bottom end of the holding groove 411 to define an ignition distance D therebetween, wherein the ignition distance D must be at least larger than a travel distance of the ignition cap 42 when the ignition cap 42 is depressed downwardly at the gas releasing position to ignite the piezoelectric lighter.

Accordingly, the piezoelectric unit 30 has a spark-generating depression distance that the movable operating part 31 of the piezoelectric unit 30 must be completely depressed at the spark-generating depression distance for generating the sparks to ignite the piezoelectric lighter, wherein the spark-generating depression distance of the piezoelectric unit 30 is defined at a sun of the radial traveling distance of the ignition cap 40 and the downward traveling distance of the ignition cap 40.

It is worth to mention that the radial traveling distance of the ignition cap 40 is defined when the ignition cap 40 is radially slid from the normal upper position to the gas releasing position, and the downward traveling distance of the ignition cap 40 is defined when the ignition 40 is downwardly depressed at the gas releasing position to completely depress the piezoelectric unit 30 for generating the sparks to ignite the piezoelectric lighter.

Figure 3A:
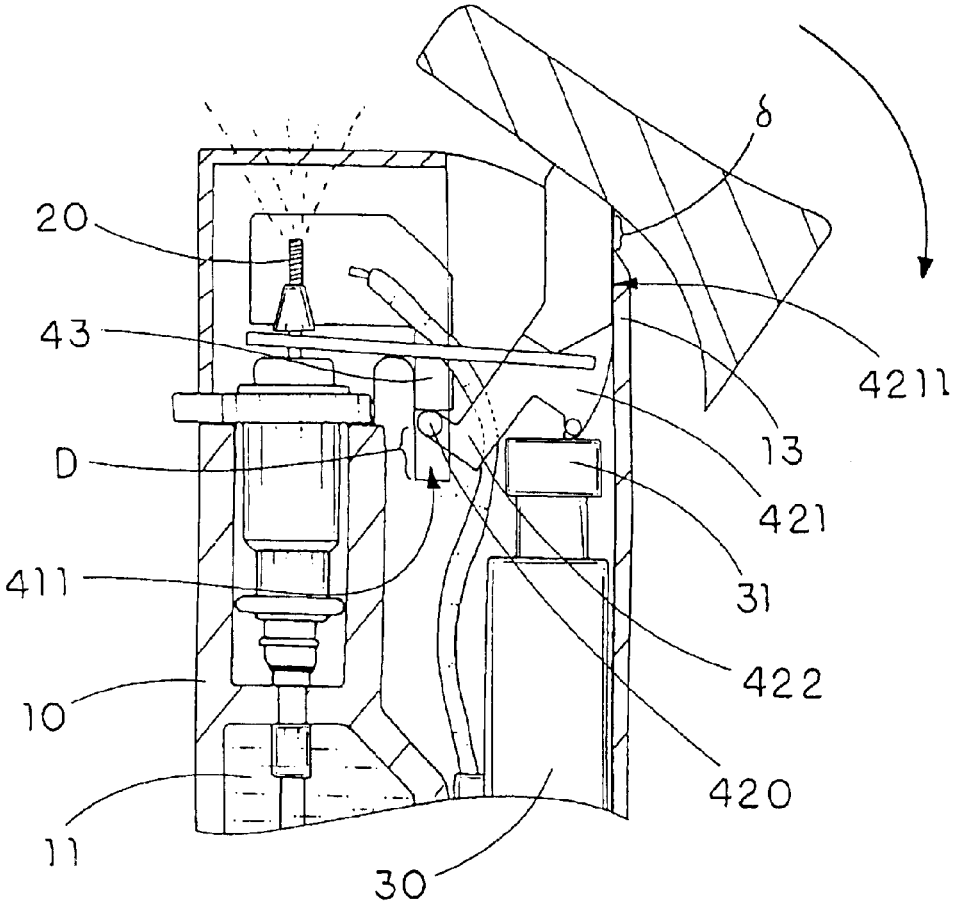
FIG. 3A illustrates the dual-action piezoelectric lighter at a gas releasing position according to the above preferred embodiment of the present invention.

As shown in FIG. 3A, each of the sidewalls 14 of the casing 10 has a curved top edge extended to a top edge of the rear wall 13 of the casing 10, wherein a curvature of each top edge of the sidewalls 14 is offset from a curvature of the ignition cap 42 that radially traveling with respect to the operation axle 420 in such a manner that when the ignition cap 42 is radially slid to the gas releasing position, a clearance δ is formed between a top portion of the ignition cap 42 and the top edge of the casing 10, so that the ignition cap 42 is capable of downwardly depressing to ignite the piezoelectric lighter.

In other words, the ignition cap 42 is substantially supported on the casing 10 at the normal position so that the ignition cap 42 cannot be downwardly depressed, as shown in FIG. 2. Moreover, the clearance δ between the top portion of the ignition cap 42 and the top edge of the casing 10 must be at least equal to the ignition distance D between the operation axle 420 and the bottom end of the holding groove 411 for completely depressing the piezoelectric unit 30 when the ignition cap 42 is downwardly depressed to ignite the piezoelectric lighter.

The depressing arm 421 is downwardly extended into the ignition cavity 12 to rest on top of the movable operating part 31 of the piezoelectric unit 30 wherein when the ignition cap 42 is radially slid to the gas releasing position, the depressing arm 421 is driven to actuate the gas emitting nozzle 20 via a gas lever 21 for releasing the gas from the liquefied gas storage 11. At the same time, the movable operating part 31 of the piezoelectric unit 30 is partially depressed. It is worth to mention that no spark is generated when the movable operating part 31 of the piezoelectric unit 30 is not totally depressed. Therefore, only gas is released through the gas emitting nozzle 20 from the liquefied gas storage 11 at the gas releasing position, so as to prevent any unintentionally ignition of the piezoelectric lighter.

The ignition cap 42 further comprises a driving arm 422 downwardly extended from the depressing arm 421, wherein the operation axle 420 is provided at a bottom end of the driving arm 422 in such a manner that when the ignition cap 42 is radially slid about the operation axle 420, the depressing arm 421 is driven radially to depress the piezoelectric unit 30 through the driving arm 422.

As shown in FIG. 2, the depressing arm 421 has a slanted rear stopping surface 4211 arranged in such a manner that when the ignition cap 42 is radially slid about the operation axle 420, the stopping surface 4211 of the depressing arm 421 is biased against a rear wall 13 of the casing 10 so as to substantially stop a radial movement of the ignition cap 42 at the gas releasing position, as shown in FIG. 3A. In other words, the depressing arm 421 is arranged not only to release the gas when the ignition cap 42 is radially slid at the gas releasing,position but also to retain the ignition cap 42 at the gas releasing position when the stopping surface 4211 of the depressing arm 421 is biased against the rear wall 13 of the casing 10.

The dual-action safety arrangement 40 further comprises an axle stopper 43 mounted within each of the holding grooves 411 at a position above the operation axle 420 to substantially block the operation axle 420 in an upwardly movable manner, so as to retain the ignition distance D of the operation axle 420 with respect to the holding groove 411. Since the operation axle 420 may be accidentally slid upward along the holding groove 411 when the ignition cap is slid radially, the axle stopper 43 can retain the position of the outer portions of the operation axle 420 within the holding grooves 411 respectively, so as to ensure the ignition operation of the piezoelectric lighter.

In order to ignite the piezoelectric lighter, a sideward sliding force F1 must be intentionally applied on the ignition cap 42 in order to radially slid the ignition cap 42 about the operation axle 420 at the gas releasing position; as shown in FIG. 3A. It is worth to mention that the two end portions of the operation axle 420 are rotated within the holding grooves 411 of the axle holder 41 respectively so as to remain the ignition distance D between the operation axle 420 and the bottom end of the holding groove 411. In addition, since the piezoelectric unit 30 is not completely depressed, no spark is generated at the gas releasing position of the ignition cap 42.

Figure 3B:
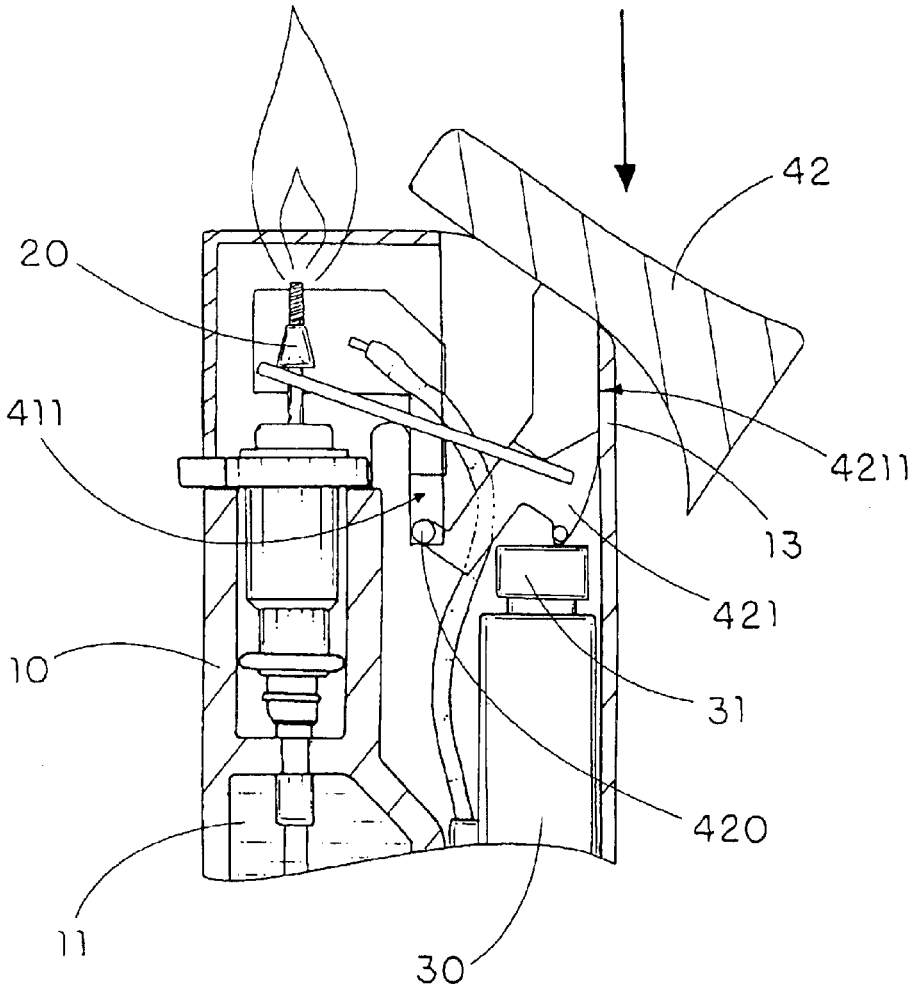
FIG. 3B illustrates the dual-action piezoelectric lighter at an ignition position according to the above preferred embodiment of the present invention.

At the same time, a downward depressing force F2 must be applied on the ignition cap 42 at the gas releasing position so that the depressing arm 421 is driven to depress the movable operating part 31 of the piezoelectric unit 30 to generate sparks to ignite the gas emitted from the gas emitting nozzle 20 so as to ignite the piezoelectric lighter, as shown in FIG. 3B. It is worth to mention that the stopping surface 4211 of the depressing arm 421 is slid on the rear wall 13 of the casing 10 so as to guide the ignition cap 42 to depress downwardly at the gas releasing position for ignition.

Due to the ignition distance D between the operation axle 420 and the bottom end of the holding groove 411, the ignition cap 42 is allowed to be depressed downwardly to totally depress the movable operating part 31 of the piezoelectric unit 30 for generating sparks. In addition, when the ignition cap 42 is depressed downwardly, the operation axle 420 is blocked at the bottom end of the holding groove 411 so as to prevent a further downward movement of the ignition cap 42.

While releasing the downward depressing force F2 on the ignition cap 42, the compressed piezoelectric unit 30 will rebound to its original form which pushes the ignition cap 42 upwardly and radially back to its original position.

Accordingly, the dual action operation of the sideward sliding force F1 and the downward depressing force F2 must be manipulated simultaneously to form a single ignition action in order to ignite the piezoelectric lighter of the present invention. Therefore, an adult's user is able to perform the dual action operation to ignite the piezoelectric lighter while the children under five are unable to complete the ignition operation. Moreover, the downward depressing force F2 must be applied after the sideward sliding force F1 is applied on the ignition cap 42 so as to prevent the unintentionally ignition of the piezoelectric lighter.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A dual-action piezoelectric lighter, comprising:

a casing receiving a liquefied gas storage and an ignition cavity provided therein;

a gas emitting nozzle disposed in said casing and communicating with said liquefied gas storage for controlling a flow of gas;

a piezoelectric unit disposed in said casing for generating piezoelectricity; and a dual-action safety arrangement, which comprises:

an axle holder provided at an inner side of said casing; and an ignition cap, which is slidably mounted on a ceiling of said casing in a radially movable manner about an operation axle held at said axle holder, comprising a depressing arm extended into said ignition cavity to rest on top of said piezoelectric unit, wherein said ignition cap is capable of moving to a gas releasing position that said ignition cap is radially and rearwardly slid to actuate said gas emitting nozzle for releasing said gas from said liquefied gas storage while said ignition cap is capable of being simultaneously depressed to depress a movable operating part of said piezoelectric unit to generate sparks to ignite said gas emitted from said gas emitting nozzle so as to ignite said piezoelectric lighter.

2. A dual-action piezoelectric lighter, as recited in claim 1, wherein said piezoelectric unit has a spark-generating depression distance that said movable operation part of said piezoelectric unit must be completely depressed at said spark-generating depression distance for generating said sparks to ignite said piezoelectric lighter, wherein said spark-generating depression distance of said piezoelectric unit is defined at a sum of a radial traveling distance and a downward traveling distance of said ignition cap.

3. A dual-action piezoelectric lighter, as recited in claim 1, wherein said axle holder has two elongated holding grooves provided at two sidewalls of said casing at said inner side thereof respectively to slidably receive two outer portions of said operation axle so as to guide said ignition cap in a radially movable manner.

4. A dual-action piezoelectric lighter, as recited in claim 2, wherein said axle holder has two elongated holding grooves provided at two sidewalls of said casing at said inner side thereof respectively to slidably receive two outer portions of said operation axle so as to guide said ignition cap in a radially movable manner.

5. A dual-action piezoelectric lighter, as recited in claim 3, wherein each outer end portion of said operation axle is positioned above a bottom end of said respective holding groove to define an ignition distance therebetween, wherein said ignition distance must be at least larger than a travel distance of said ignition cap when said ignition cap is depressed downwardly at said gas releasing position to ignite said piezoelectric lighter.

6. A dual-action piezoelectric lighter, as recited in claim 4, wherein each outer end portion of said operation axle is positioned above a bottom end of said respective holding groove to define an ignition distance therebetween, wherein said ignition distance must be at least larger than a travel distance of said ignition cap when said ignition cap is depressed downwardly at said gas releasing position to ignite said piezoelectric lighter.

7. A dual-action piezoelectric lighter, as recited in claim 3, wherein said dual-action safety arrangement further comprises an axle stopper mounted within each of said holding grooves at a position above said operation axle to substantially block said operation axle in an upwardly movable manner.

8. A dual-action piezoelectric lighter, as recited in claim 4, wherein said dual-action safety arrangement further comprises an axle stopper mounted within each of said holding grooves at a position above said operation axle to substantially block said operation axle in an upwardly movable manner.

9. A dual-action piezoelectric lighter, as recited in claim 6, wherein said dual-action safety arrangement further comprises an axle stopper mounted within each of said holding grooves at a position above said operation axle to substantially block said operation axle in an upwardly movable manner.

10. A dual-action piezoelectric lighter, as recited in claim 2, wherein said depressing arm has a slanted rear stopping surface arranged in such a manner that when said ignition cap is radially slid about said operation axle, said stopping surface of said depressing arm is biased against a rear wall of said casing so as to substantially stop said ignition cap at said gas releasing position.

11. A dual-action piezoelectric lighter, as recited in claim 4, wherein said depressing arm has a slanted rear stopping surface arranged in such a manner that when said ignition cap is radially slid about said operation axle, said stopping surface of said depressing arm is biased against a rear wall of said casing so as to substantially stop said ignition cap at said gas releasing position.

12. A dual-action piezoelectric lighter, as recited in claim 6, wherein said depressing arm has a slanted rear stopping surface arranged in such a manner that when said ignition cap is radially slid about said operation axle, said stopping surface of said depressing arm is biased against a rear wall of said casing so as to substantially stop said ignition cap at said gas releasing position.

13. A dual-action piezoelectric lighter, as recited in claim 9, wherein said depressing arm has a slanted rear stopping surface arranged in such a manner that when said ignition cap is radially slid about said operation axle, said stopping surface of said depressing arm is biased against a rear wall of said casing so as to substantially stop said ignition cap at said gas releasing position.

14. A dual-action piezoelectric lighter, as recited in claim 2, wherein each of sidewalls of said casing has a curved top edge extended rearwardly, wherein a curvature of each top edge of said sidewalls is offset from a curvature of said ignition cap that radially traveling with respect to said operation axle in such a manner that when said ignition cap is radially slid to said gas releasing position, a clearance is formed between a top portion of said ignition cap and said top edge of said casing, so that said ignition cap is capable of downwardly depressing to ignite said piezoelectric lighter.

15. A dual-action piezoelectric lighter, as recited in claim 6, wherein each of sidewalls of said casing has a curved top edge extended rearwardly, wherein a curvature of each top edge of said sidewalls is offset from a curvature of said ignition cap that radially traveling with respect to said operation axle in such a manner that when said ignition cap is radially slid to said gas releasing position, a clearance is formed between a top portion of said ignition cap and said top edge of said casing, so that said ignition cap is capable of downwardly depressing to ignite said piezoelectric lighter.

16. A dual-action piezoelectric lighter, as recited in claim 9, wherein each of sidewalls of said casing has a curved top edge extended rearwardly, wherein a curvature of each top edge of said sidewalls is offset from a curvature of said ignition cap that radially traveling with respect to said operation axle in such a manner that when said ignition cap is radially slid to said gas releasing position, a clearance is formed between a top portion of said ignition cap and said top edge of said casing, so that said ignition cap is capable of downwardly depressing to ignite said piezoelectric lighter.

17. A dual-action piezoelectric lighter, as recited in claim 13, wherein each of sidewalls of said casing has a curved top edge extended rearwardly, wherein a curvature of each top edge of said sidewalls is offset from a curvature of said ignition cap that radially traveling with respect to said operation axle in such a manner that when said ignition cap is radially slid to said gas releasing position, a clearance is formed between a top portion of said ignition cap and said top edge of said casing, so that said ignition cap is capable of downwardly depressing to ignite said piezoelectric lighter.

18. A dual-action piezoelectric lighter, as recited in claim 6, wherein said ignition cap further comprises a driving arm downwardly extended from said depressing arm, wherein said operation axle is provided at a bottom end of said driving arm in such a manner that when said ignition cap is radially slid about said operation axle, said depressing arm is driven radially to depress said piezoelectric unit through said driving arm.

19. A dual-action piezoelectric lighter, as recited in claim 13, wherein said ignition cap further comprises a driving arm downwardly extended from said depressing arm, wherein said operation axle is provided at a bottom end of said driving arm in such a manner that when said ignition cap is radially slid about said operation axle, said depressing arm is driven radially to depress said piezoelectric unit through said driving arm.

20. A dual-action piezoelectric lighter, as recited in claim 17, wherein said ignition cap further comprises a driving arm downwardly extended from said depressing arm wherein said operation axle is provided at a bottom end of said driving arm in such a manner that when said ignition cap is radially slid about said operation axle, said depressing arm is driven radially to depress said piezoelectric unit through said driving arm.

* * * * *